United States Patent [19]

Thompson

[11] Patent Number: 4,845,925

[45] Date of Patent: Jul. 11, 1989

[54] CUSHION COVER STUFFING MACHINE AND METHOD

[76] Inventor: James A. Thompson, 38383 Plainview Dr., Sterling Heights, Mich. 48077

[21] Appl. No.: 189,344

[22] Filed: May 2, 1988

[51] Int. Cl.[4] ..... B65B 1/24; B65B 5/04; B65B 39/06; B65B 63/02

[52] U.S. Cl. ..... 53/438; 53/258; 53/524; 53/529

[58] Field of Search ..... 29/91.1, 91.5, 431; 53/243, 255, 257, 258, 261, 392, 436, 438, 439, 459, 469, 521, 524, 527, 529, 530, 576

[56] References Cited

U.S. PATENT DOCUMENTS

| | | | |
|---|---|---|---|
| 568,648 | 9/1896 | White | 53/524 X |
| 2,693,304 | 11/1954 | Davis et al. | 53/524 |
| 2,749,690 | 6/1956 | Bridges et al. | 53/524 |
| 2,907,156 | 10/1959 | Anderson | 53/258 X |
| 3,161,003 | 12/1964 | Grintz | 53/255 |
| 3,270,485 | 9/1966 | Knepper | 53/255 |
| 3,660,964 | 5/1972 | Willis et al. | 53/524 |
| 4,300,327 | 11/1981 | Bridger | 53/258 |
| 4,679,379 | 7/1987 | Cassoli | 53/438 |
| 4,711,067 | 12/1987 | Magni | 53/439 |

*Primary Examiner*—Robert L. Spruill
*Assistant Examiner*—Beth Bianca
*Attorney, Agent, or Firm*—Gifford, Groh, Sheridan, Sprinkle and Dolgorukov

[57] ABSTRACT

A method and apparatus for applying a cover to a cushion of larger size than the cover by forcing the cushion into a confining chamber which reduces the size of the cushion. The cover is then slid over the cushion. The cushion is then expelled from the chamber taking the cover with it. The cushion expands within the cover as it leaves the confining chamber.

16 Claims, 2 Drawing Sheets

CUSHION COVER STUFFING MACHINE AND METHOD

The invention relates to a method and apparatus for applying covers to cushions covered with foam. Such cushions are used in the manufacture of seats and other stuffed goods for the automotive and furniture industries.

It is common practice to apply various types and kinds of fabrics and other covering materials to foam cushions, particularly foam-covered cushions having stiffening frames, by simply forcing the covers over the foamed cushions. For example, in a commonly used method, workers manually handle seatback frames covered with the desired foam materials formed in the various shapes required to obtain desired finished contours. The workers place fabrics and the like covers over the foam covered frames by means which primarily amounts to manhandling the cover onto the seatback. This is a tedious and physically demanding task. Very often the cover is inverted so that it is forced onto the foam-frame unit in a reverse manner from which it will finally appear. That is the cover which is usually complete except one end is left open, is forced inside out back over itself toward the closed opposite end to form a pocketlike section in the same manner that a sock or bag might be turned inside out prior to applying the sock or bag. The cover is now inside out and the closed end of the inverted cover is placed onto one edge of the seatback and then the remainder is pulled down over the foam and frame. The foam is compressed by this action so as to fill out the cover as it is advanced.

In order to have a decent appearing seat and be sure that the foam fills out the cover, it is necessary that the foam initially, that is before the fabric cover is applied, has an expanded size greater than that of the finished seat member. Then when the cover is pulled into place, the foam will tend to fill in all areas of the cover. This alone contributes greatly to the difficulty of applying the covers manually to the foam, since considerable force must be applied to pull the covers onto the cushion material.

Workers whose job requires the use of their hands and wrists in forcing the fabrics over the foam seatbacks often become victims of Carpal Tunnel Syndrome. This is a condition in which the branch of the median nerve in the forearm is compressed at the wrist as it passes through the tunnel formed by the wrist bones and the ligament that lies just under the skin. Many employees who are engaged in applying fabrics to automotive seatbacks or the like have to wear tape reinforcements on their arms and wrists similarly to what is observed on athletes engaged in contact sports because of the strenuous nature of the task.

PRIOR ART

U.S. Pat. No. 4,385,427, issued May 31, 1983 to Fraiser discloses one attempt to provide a means for mechanically applying covers to seatbacks. According to this patent, a seatback is placed on a platform and then an inside out seatcover is placed over a series of arms above the seatback. The seat platform can then be moved upwardly to initially force the seatback into the cover. Thereafter a number of the arms are forced downwardly further forcing the seatcover over the cushion. A series of rollers are provided on the depending arms to facilitate the movement of the arms within the insideout covers and the forcing of the covers over the seatbacks. A complex series of movable rollers, arms and a platform are required including overhead components, and vertically extending frame members.

SUMMARY OF THE INVENTION

According to the invention a method of applying covers to seatbacks and other cushion devices is provided wherein foam covered frames normally larger than the baglike covers to be applied are constrained and held in a shape in which they are dimensionally of a smaller size than the internal dimension of the seatcover or the like. While in this state, the cover is simply placed around the foam covered frame. Then the frame and cover are released from any constraints whereupon the seatcover is in proper position upon the fully enclosed seatback which fills and exerts interior pressure in the normal manner within the cover. This is accomplished without any excessive force being applied by the operators. Further, according to the method, the operator's hands can be free of the seatback or the like while manipulating the cover over the constrained foam covered frame. In addition, the movement over the frame is a simple sliding movement without any great amount of force being required and without great risk of damage to the cover.

In addition, according to the invention, there is provided a means for mechanically accomplishing this new method which includes a chute-like funnel through which the cushion member is moved from one end to the other. The cover is placed upon the cushion member while it is in the chute-like funnel. Also while the cushion is within the chute-like funnel and the cover is applied, any additional function such as hog-ring attachment of a section of a cover can be accomplished with ease. Furthermore, according to the invention, there is provided a continuous pass-through arrangement for the seatback or the like. The back progressively acquires the seatcover as it is moved through the funnel. It leaves the chute in a continuous movement while the as yet uncovered portion of the seatback is still compressed within the confines of the chute. In addition, according to the invention, when the cushion is forced within a confining area such as the chute-like funnel, the chute-like funnel is rotated, the cover is applied and the cushion is forced outwardly of the confining area carrying the cover with it.

According to the invention and by utilization of the apparatus according to the invention, the foam covered cushion is pushed downwardly into a confined space thereby compressing the foam covered frame to a size along its length such that the cover can be simply slipped over the cushion while the latter is so constrained. To apply the cover after the foam covered cushion is compressed, the cushion is inverted and the cover is slid over the cushion. In some instances the cover is turned partially or wholely inside out and then slid over the inverted cushion. In either event the application of the cover is also accomplished in a downward movement. This movement of the cover can be stopped at any time. A worker can have both his hands free for attachment of a section of the cover to an exposed part of a seat frame, for example, leaving the assemblage as it is without fear of separation. Then when that step is finished, the worker simply continues movement of the cover relative the cushion. On the other hand, with the cushion confined and the cover immediately over the cushion and any additional steps completed, the operator can simply initiate movement of the cushion outwardly of the confined area, the chute-like funnel, while holding the cover in place. The cover will be pulled outwardly with the cushion by this movement until the fabric completely surrounds the foam. If the cover is still partly inside out, it will be turned inside in and surround the foam. A pneumatic cylinder is preferably provided for urging the cushion outwardly during this operation, although an hydraulicly operated cylinder could also be used. The result is the operator can simply push a cushion down into a confining area such as created by a chute-like funnel until a portion of the foam covered frame is compressed. Then the movement of the cushion is stopped and the cushion and the confining means rotated preferably 180 degrees. Next the closed end of the cover is placed over the confined cushion by sliding it also downwardly. Thereafter the cover can be further closed over the cushion by pushing the cushion through and upwardly out of the confining area. The cover, during the latter movement, progressively contacts the cushion as the cushion is coming out of the confining area and just before the cushion reexpands towards its unconfined shape. The result is that oversized foam covered seat sections can have their fabric etc. covers placed thereon easily according to my invention.

In some instances it is known that there is skimping on the foam covering of seats and the like in order to make it easier for operators to manually force fabric over them. With my invention this is not necessary and the advantages of using oversized foam which will fully fill out the cover and which will more readily hide sewing errors and the like will be obtained. According to the prior art, as performed in many instances, the foam must be compressed manually as the material goes on. In other words, there is a tugging going on with the operator holding on to the cushion and trying to force the covering over it at the same time. In another instance, a machine might be employed but it is of an elaborate nature, and must compress the foam as the cover is being forced over it. According to the instant invention, the foam is compressed and maintained in the compressed condition. The fabric is then placed in position surrounding the foam without actually coming in contact with the foam because the foam is compressed to a dimension which is less than the internal dimensions of the fabric. It is only as the foam is pushed outwardly of the chute-like funnel that there is contact between the cushion and the cover. That contact occurs as the cushion is permitted to expand and the cover easily slips over the cushion before expansion occurs.

The chute-like funnel is preferably mounted upon a shaft and is rotated so that its larger open normally upper end faces upwardly for insertion of the foam covered frame. The foam covered frame is then simply turned upside down and forced downwardly into the funnel until the cushion is forced all the way in. At this time the upper end of the cushion can be actually projecting slightly beneath the chute end of the funnel to a position the operator may prefer for slipping the fabric over the cushion. Next the operator might prefer to turn the funnel half way up approximately 90 degrees or fully 180 degrees upwardly. He then slips the fabric cover over the cushion down over the outside of the funnel-chute. The cushion has been compressed within the chute in the process of pushing it down within the funnel. It has been compressed to such an extent that the fabric sheath of the cover slides right over the cushion and over the exterior of the chute. For the final step the funnel-chute is positioned vertically upwardly with the top end of the seat cushion facing upwardly. In other words, it is 180 degrees reversed from the position in which it was when the cushion was first forced downwardly into the chute. The operator, while the cover is now in place and while holding on to the cover, can now actuate a piston associated with a pusher plate and cause the latter to rise up into the funnel. This will push the cushion upwardly forcing the cushion outwardly of the now upper end of the chute at the same time pulling the cover along with it. The cover will in the process simply take its proper position on the exterior of the cushion. The cushion expands as it acquires the cover and fully fills the cover.

DETAILED DESCRIPTION OF A PREFERRED FORM OF THE INVENTION

Figure 1:
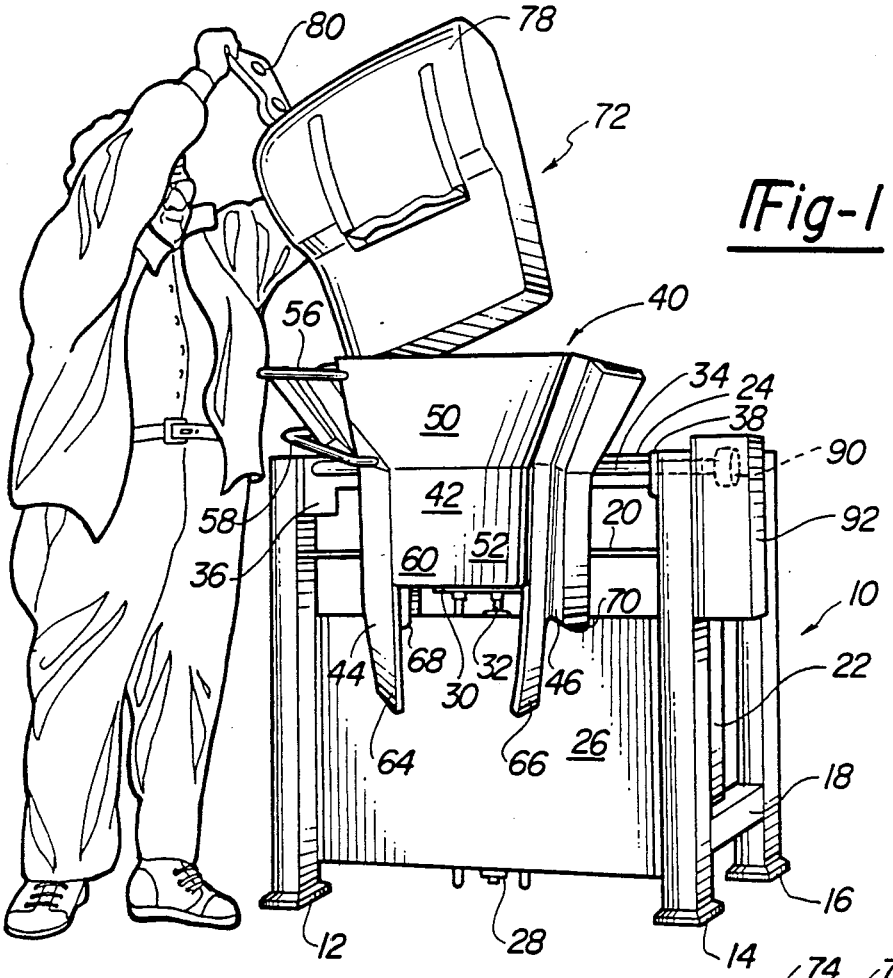
FIG. 1 is a perspective view of a machine constructed in accordance with the invention and showing a first step in the method.
Figure 4:
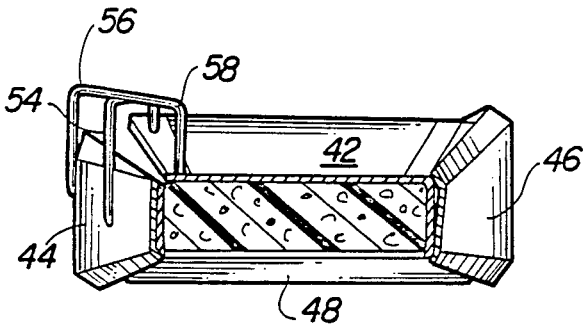
FIG. 4 is a section taken along line 4—4 of FIG. 3.

Referring now to the drawings, a preferred form of cushion stuffing machine according to the invention is shown to comprise a stand 10 having columns such as 12, 14 and 16 interconnected by braces and cross members such as braces 18, 20, 22 and 24 and a stiffening sheet 26. Sheet 26 also functions to provide a support for an air cylinder 28 and the ram block 30 connected to the piston rod 32 of cylinder 28. A shaft 34 is pivotally mounted in bearing blocks 36 and 38 so that the shaft can rotate freely about a horizontal axis.

A chute 40 comprised of sheet metal sections 42, 44, 46 and 48 is secured to shaft 34 preferably by welding. The chute thus is rotatably attached to the stand 10. The shaft 34 lies substantially directly above sheet 26 and the chute is fastened to shaft 34 along the rear side 48 of the chute and above the center of gravity of the chute. The chute is formed to have a funnel like upper structure 50 when positioned as in FIG. 1 with this funnel like upper portion extending above and leading into a more regular parallelepiped chute like lower section 52. This is achieved by cutting the side members or sections 42–48 from sheet stock and then welding along mating edges. In the preferred form shown, the chute members are not joined along one pair of mating edges. Instead an opening 54 is left between them for reasons explained below. To provide the necessary rigidity, despite the gap thus left, stiffening braces 56 and 58 in the form of stiff rods are secured to the upper portion 50 adjacent the gap. The front facing section 60 of lower chute like section 52 extends a greater distance below upper portion 50, FIG. 1, than does the rear facing segment 52, FIG. 3, and is thus longer than segment 62. The purpose for the difference is to provide more open space in the rear of the chute for attaching hog-rings or brackets to a cushion frame in a manner commonly done at the rear side of seatbacks.

The more chute like lower portion 52 of chute 40 includes extending arms or brackets 64, 66, 68 and 70 spaced transversely of the chute. These arms continue the inner parallelepiped shape of the chute 40–52 beyond the lower ends of the sheet metal sections 42, 44, 46 and 48. Basically the brackets form a continuance of the fully confining shape of the chute within the section 52. As shown the forward pair of brackets 64 and 66 extend a greater distance downwardly, FIG. 1, than the rearward arms 68 and 70. The front of the chute is intended to receive the front facing section of the cushion as hereinafter described and more guidance and confinement of the foam is required here than at the rear for the typical auto seat back cushion described below. The arms are formed so as to provide the desired stiffness and ensure continuance of the chute like enclosure effect upon the cushion elements as they pass through the funnel-chute.

Figure 2:
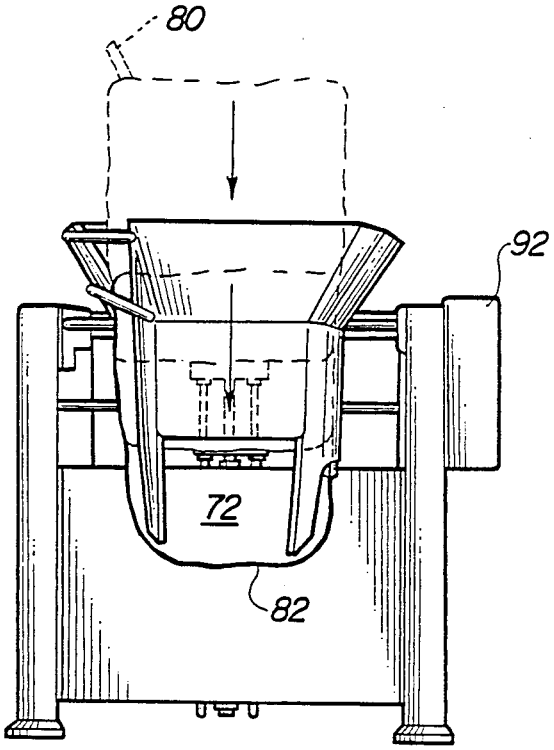
FIG. 2 is an elevational view thereof and showing the elements in a further position.

With the chute attached to the shaft at one side, the chute tends to rotate the shaft until the center of gravity of the chute is in line vertically with the shaft. The sheet 26, however, is positioned below the shaft and limits rotation to a position as shown in which the funnel like upper portion faces upwardly as shown in FIGS. 1 and 2. The chute is attached to the shaft 34 near its center of gravity and thus is easy to rotate. An operator positioned as shown in FIG. 1 can easily rotate the chute through 180 degrees. The chute is approximately centrally positioned along the length of the shaft.

Figure 3:
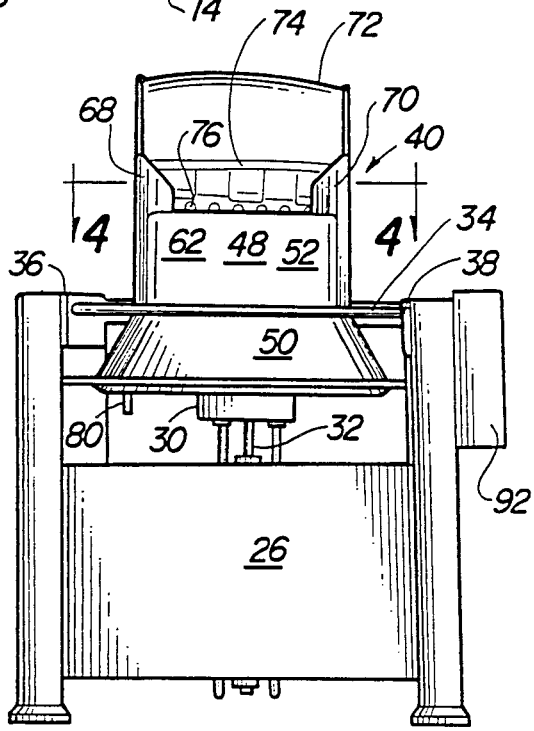
FIG. 3 is a front elevational view similar to that of FIG. 2 but showing portions of the apparatus in different relative positions and also a further stage in the method.

The upper end of the stand is open and the cylinder 28 and ram block 30 are in position with respect to the shaft 34 and the chute 40 such that the block 30 will be vertically positioned within the centerline of the chute when the chute is rotated 180 degrees from the position shown in FIG. 1 to that shown in FIG. 3. The funnel-chute can be flipped easily from one position to the other, that is from a vertical position with the funnel like end up to a position 180 degrees opposite thereto. Due to the fact that the pivot axis is at one side of the chute the two vertical positions are offset the width of the chute from each other.

In the first position shown, FIG. 1, a seatback 72 is shown in inverted position about to be thrust downward into the chute 40. The front of the cushion is shown. The rear of the seatback is not as completely covered with foam as is well known. The portion of the frame having cross member 74 and the spring 76 attached thereto is exposed in the rear. The front of the frame on the other hand is completely covered with foam cushioning material of the type commonly employed in the auto seat cushion industry. The finished cushion will have a fabric or leather covering. Also the cushion can come with various other features. There are various grades of seats, and seating materials. In all instances the internal frame is covered with foam and that foam covered unit must be finally enclosed by the outer cover. It is desirable that the outer cover be completely filled with foam and be without slack or voids. To accomplish this the foam covering must be of a size to tension the fabric or other final cover, i.e. it must be initially larger than the cover. In practice, this difference in size causes the difficulty in assembling of the cover onto the foam covered frame. If manually performed, which is usually the case, workers have to struggle to get the covers on. This is apt to be particularly true where heavily ribbed cushions are used and/or cushions having inserted contour modifying means.

In the illustrated model the front of the cushion is seen to have a lumbar region enlargement 78. An electrical control unit or connector 80 is shown attached thereto for operation of seat modifying devices known in the art. Connector unit 80 will remain outside the seat cover. The control unit can be accommodated by virtue of the opening 54 in the funnel-chute. The enlarged cushion area 78 as well as the remainder of the cushion member is of a greater size peripherally than a cover which is intended to be placed on the foam insert. The end 78, it will be understood, will actually be at the lower end of the cushion when finally installed in the vehicle. The chute is designed to receive and depress the foam externally to a size less than that of a cover to be placed over the cushion. The lead end funnel section is designed to gradually compress the foam as it is forced downwardly through the funnel and into the chute section. The workman simply pushes the seatback down into the chute until it reaches the position shown by the solid line 82 in FIG. 2. When this condition is reached the chute is rotated 180 degrees until it is in the position shown in FIGS. 3 and 6.

Figure 6:
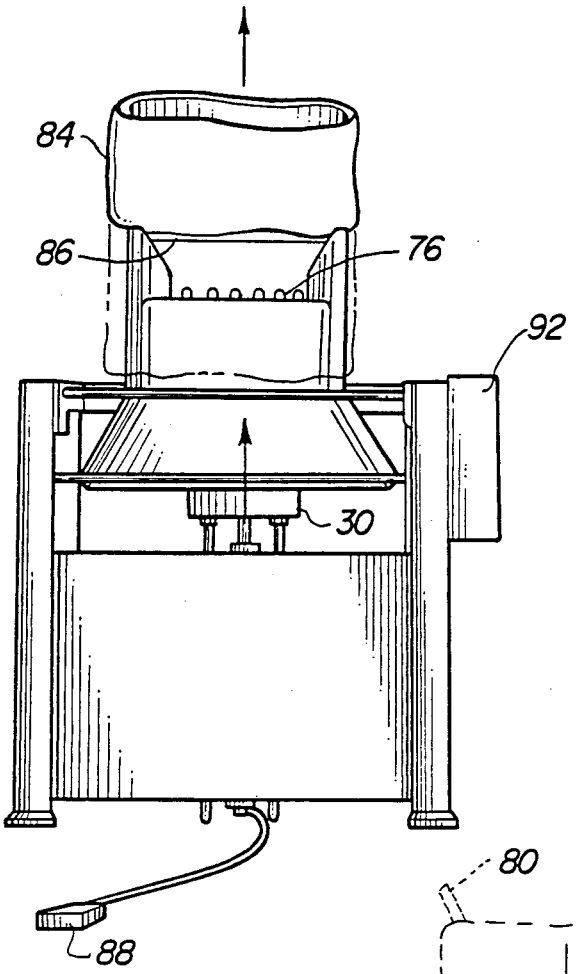
FIG. 6 is a front elevational view similar to FIG. 3 but showing a further step in the method and a cover in association with a seat cushion-frame member.
Figure 5:
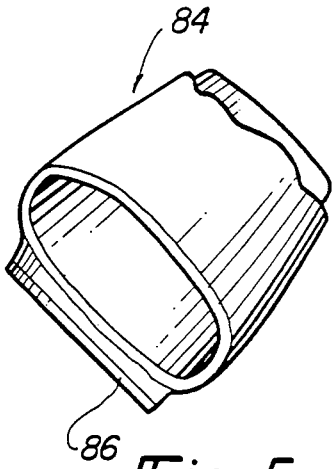
FIG. 5 is a perspective view of a seat cover.

The fabric cover 84 is turned inside out as in the example shown in FIG. 5 before applying it to the chute. Also shown in FIG. 5 is a clip 86 attached to the cover. When rotated to the position shown in FIG. 6 the front of the cushion is now facing to the rear and the back of the cushion is shown in FIG. 6. The cover can then be slipped down over the chute and over the compressed cushion with the clip 86 to the rear. The clip is then snapped onto the exposed cross member 74 of the cushion frame. This is made possible by the open nature of the back of the chute. Such a clip, or hog-rings, are commonly employed in covering auto seat cushions. Once this is accomplished the remainder of the cover can be rolled down over the chute as indicated by the dashed line in FIG. 6. The operator then simply presses the foot pedal 88 actuating the air-operated cylinder to cause upward movement of the block 30. The seatback will now be forced upwardly and outwardly of the chute pulling the fabric cover with it. As this occurs the foam expands within the cover as it leaves the confined space defined by the chute. Any portion of the cover that may be still turned in upon itself can be restrained manually as the cushion moves out so that the cover rerolls to its proper outside inside relationship. Also if the step of attaching clip 86 is not involved, the movement of the fabric over the chute can be accomplished in one single step. Furthermore, covers can be applied without first turning them inside out in whole or part. This would be quite likely the case where a clip such as 86 would not be employed. Chute 40 is sized so that the cover can be readily slipped over the chute while the cushion is restrained within it.

A brake 90 is provided for shaft 34 within housing 92. The brake can be of the disc type as indicated in FIG. 1, or any of other form of brake suitable for locking shaft 34 in a selected position, such as in one of the positions shown in FIGS. 1 and 6 or any intermediate position. A worker might prefer to apply a cover to chute 40 when cushion end 82 is rotated 90–100 degrees above the position shown in FIG. 2. The lock would be used to retain the chute in this position while the cover is applied. Thereafter the rotation of the chute to the position shown in FIG. 6 can be completed and the chute locked in the latter position while the cushion is ejected.

There has been shown a form of the invention in which a cushion for a seat back is used as an example. The invention may easily be used for stuffing arm rests, head rests, and other cushioned articles of furniture by simply providing different shapes to the chute. While some products may be broader than long, others may be longer than wide or of equal length and width. Likewise, thicknesses may well vary. All are, however, within the scope of my invention.

The new method of applying a seat cover having a sleeve-like shape to a seat cushion having an exterior periphery along its length greater than the untensioned internal peripheral dimension of the cover, comprises compressing the seat cushion transversely inwardly along its length until the cushion achieves a shape in which the cover can be easily slipped over and along the length of the cushion. According to the method, the cushion then is confined and retained in its compressed state with a restraining means.

While the cushion is thus restrained, the cover is slipped at least partially over the cushion from one end thereof. In the illustrated case, the sleeve-like cover which is closed at one end, or at least necked down at one end to a much narrower opening than at its opposite end, is turned inside out for a portion of its length and then slipped over the cushion in a manner like that in which a rolled-up sock is applied; and the cover is moved over the cushion until it contacts the end of the cushion. Then the clip 86 is secured to the cushion frame. Thereafter, the cushion is moved outwardly in a longitudinal direction from the restraining means and toward the closed end of the cover. As the cushion thus moves, it bears against the closed end of the cover and pulls the cover with it. At the same time, as the cushion is moving out of the restraining means, the cushion expands. This expansion within the cover fills out the cover. The outward movement of the cushion continues until the cover is completely returned to its normal inside-outside relationship and is "stuffed" by the cushion.

The method further includes the concept of moving the cushion in a straight through, in-line, manner in first compressing the cushion, and finally forcing it outwardly of the compressing-confining area. Further the cushion is moved in a straight downward thrust-like motion into the confining means and is gradually reduced in size in such move. The thrust can be accomplished manually.

The end to which the cover is first applied is facing downward after the cushion has been forced into the restraining device. If the cover were to be pulled onto the cushion while it is in the latter position, the cover would have to be pulled upwardly to encompass the cushion. According to the invention, however, the method further includes rotating the confined cushion until the latter is raised to a more convenient position for manually applying the cover to the cushion, and then the cover is applied to the cushion. In the preferred form shown, the cushion is rotated 180 degrees. The end to which the cover is applied is now facing upwardly. The cover can now be applied in a second downward movement. As a final step, the cushion is expelled from the restraining means by a powered operator.

Thus, the method contemplates forcing the cushion into a confined area, rotating it while confined, applying a cover by slipping it at least partially over the confined cushion, then forcing the cushion outwardly of the confined area. At the same time that the cushion is forced outwardly, it forces the cover to follow it. Likewise, as this latter step is occurring, the cushion expands and fills out the cover.

It is apparent that the cover actually also is slipped over the chute—the restraining means—when it is applied to the cushion. The whole is preferably arranged so that the cover slips easily over the cushion and the chute restraining means, and then moves easily therefrom as the cushion is forced outwardly of the chute taking the cover with it and filling the cover at the same time that the cover covers the cushion.

Having thus described the present invention by way of an example of structure well designed to achieve the objects of the invention, modifications whereof will be apparent to those skilled in the art, what is claimed as new is as follows:

I claim:

1. A cushion cover stuffing machine comprising a chute having a first end adapted to receive a seat cushion and a second end longitudinally spaced from said first end and adapted for exit of said cushion therefrom, Means rotatably supporting said chute for rotation about a horizontal axis from a first position in which said first end is facing upwardly to a second position in which said first end is facing downwardly, said chute being shaped to enclose and compress a cushion moved therethrough transversely of said cushion, the exterior of said chute being of a peripheral size for a portion of its length so as to be freely enclosed by a cover for said cushion having an inner periphery of a size less than the uncompressed periphery of said cushion and means movable longitudinally within said chute to force a cushion therein outwardly of said second end of said chute when said chute is in said second position.

2. The cushion cover stuffing machine of claim 1 including said chute being generally of uniform cross section longitudinally along its inner surface inwardly of said first end whereby a foam cushion will be compressed uniformly as it passes through said chute.

3. The cushion cover stuffing machine of claim 1 wherein said chute comprises a first section formed of substantially sheet like material and a second section extending outwardly therefrom and forming a continuation thereof said second section comprising a series of arms forming extensions of said first section and spaced transversely of said chute whereby portions of a cushion received therein are exposed to view within said second section but confined within a zone of compression substantially of uniform size along the length of said chute and along the length of a cushion received therein.

4. The cushion cover stuffing machine of claim 1 including said chute being rotatable about an axis extending laterally thereof adjacent one side thereof.

5. The cushion cover stuffing machine of claim 1 wherein said chute is supported by a shaft fastened to one side thereof and is rotatable from a first position in which said chute is positioned to one side of said shaft to a second position in which said chute is positioned to an opposite side of said shaft whereby said chute can be rotated from a first position in which its inlet end faces in one direction to a second position in which said inlet end faces in a second direction.

6. The cushion stuffing machine of claim 1 wherein said chute includes a funnel like leadin section tapering inwardly toward said first end and adapted to receive and compress a cushion to be moved through said chute.

7. A cushion cover stuffing machine comprising a shaft mounted for rotation about an axis, a chute affixed to said shaft, said chute forming a enclosure extending transversely of said shaft and having an inlet end and an outlet end, said chute being rotatable from a first position in which said inlet end is positioned above said outlet end to a second position in which said inlet end is positioned below said outlet end, said chute being positioned substantially to one side of said shaft when in said first position and to an opposite side of said shaft when in said second position, means movable longitudinally within said chute to force a cushion therein outwardly of said outlet end of said chute when said chute is in said second position, said chute being arranged so that a cover for a cushion received in said chute can be slipped over said chute from said outlet end thereof.

8. The cushion cover stuffing machine of claim 7 wherein said means for forcing said cushion outwardly of said outlet end comprises a power operated device.

9. The cushion cover stuffing machine of claim 7 wherein said means for forcing said cushion outwardly is movable upwardly into said chute when said chute is positioned thereabove.

10. The cushion cover stuffing machine of claim 7 including said chute having a funnel like section tapering inwardly toward said inlet end and leading into said chute, and adapted for progressively compressing a cushion moved through said funnel into said inlet.

11. A cushion cover stuffing machine comprising a section presenting an elongate parallelepiped member formed of facing side members and having generally smooth aligned inner and outer faces, said member forming a chute like enclosure adapted to confine a cushion element therein having a greater exterior transverse periphery than the inner transverse pheriphery of said chute like enclosure, a leadin funnel section forming part of said member and having generally sloping inner facing sides extending inwardly of said funnel section to the facing side members of said chute like enclosure and constituting a means for directing a cushion element into said confining chute like enclosure and compressing said cushion element to a shape conformable to said chute like enclosure so that said cushion may be forced into the confining area within said chute like enclosure, means rotatably mounting said enclosure for rotation about an axis transverse of said enclosure and for movement from a first position in which said funnel section lies above said enclosure to a second position wherein said funnel section lies below said enclosure, and means insertable through said funnel section when in said second position for forcing the cushion element outwardly of said enclosure.

12. The cushion cover stuffing machine of claim 11 including means for restricting rotational movement of said chute like enclosure.

13. The cushion cover stuffing machine of claim 11 including said chute like enclosure having an exterior surface substantially parallel to the interior surface of said chute like enclosure longitudinally thereof and adapted to be encompassed by a sleeve like cover for a cushion compressed within said enclosure.

14. The cushion stuffing machine of claim 11 including said facing side members comprising a first segment and a second segment extending longitudinally of said enclosure one of said segments being of greater length longitudinally of said chute than the other so as to provide means for obtaining access to a seat cushion like member positioned within said enclosure from one side of said enclosure.

15. A method of applying a cover member to a cushion having a periphery transversely of its length greater than the internal periphery of the cover member transversely of the corresponding length of the cover member comprising compressing the cushion to a reduced size transversely of its length by forcing said cushion downwardly into a confining means retaining said cushion under compression within said confining means rotating said cushion, slipping the open end of a cover member normally of an untensioned internal periphery transversely of its length less than the free uncompressed transverse periphery of said cushion over a portion of said cushion while said cushion is in said rotating condition and within said restraining means and until the cover bears against one end of said cushion forcing said cushion outwardly from said restraining means in a direction to continue engagement of the cover against the one end of the cushion thereby moving said cushion progressively into direct contact along its length with said cover and causing said cover to move with said cushion, and permitting said cushion to expand within said cover progressively as it moves outwardly of said restraining means.

16. A method for applying a sleeve-like cushion cover having one end which is at least partially closed upon a cushion having an uncompressed peripheral extent greater than the internal periphery transversely of the length of said sleeve comprising compressing said cushion to a size laterally of its length less than the corresponding size of the cover by forcing the cushion downwardly into a confining means until one end of said cushion projects outwardly of the confining means, retaining said cushion in the compressed condition, rotating said cushion, applying the cover around a first portion of said cushion in said rotated condition by sliding said cover over one end of said cushion until said one end of said cover contacts said one end of said cushion, moving said cushion in engagement with said cover end portion to force said cushion outwardly from said confining means thereby causing movement of said cover with said cushion and over said cushion to draw said cover along said cushion causing said cushion to expand by the latter said movement within said cover and continuing said movement until said cover completely engages and surrounds said cushion as said cushion moves and expands in moving out of said confining means.

* * * * *